US012667203B2

(12) United States Patent
Kappenman

(10) Patent No.: US 12,667,203 B2
(45) Date of Patent: Jun. 30, 2026

(54) MATTRESS

(71) Applicant: Bed Patent Holdings Limited Liability Company, Las Vegas, NV (US)

(72) Inventor: Kevin J. Kappenman, Huntington Beach, CA (US)

(73) Assignee: Bed Patent Holdings Limited Liability Company, Las Vegas, NV (US)

( * ) Notice: Subject to any disclaimer, the term of this patent is extended or adjusted under 35 U.S.C. 154(b) by 64 days.

(21) Appl. No.: 18/613,337

(22) Filed: Mar. 22, 2024

(65) Prior Publication Data

US 2024/0315466 A1 Sep. 26, 2024

Related U.S. Application Data

(60) Provisional application No. 63/454,033, filed on Mar. 22, 2023.

(51) Int. Cl.
*A47C 27/15* (2006.01)
*A47C 27/20* (2006.01)

(52) U.S. Cl.
CPC ..... *A47C 27/15* (2013.01); *A47C 27/20* (2013.01)

(58) Field of Classification Search
CPC ..... A47C 27/15; A47C 27/20; A47C 27/16
See application file for complete search history.

(56) References Cited

U.S. PATENT DOCUMENTS 5,325,553 A * 7/1994 Ripley ..... A47C 27/0456 5/721
5,426,799 A * 6/1995 Ottiger ..... A47C 27/065 5/247
5,867,852 A * 2/1999 Knight ..... A47C 23/28 24/270
6,343,394 B1 * 2/2002 Gandolfi ..... A47C 27/065 5/690
9,867,476 B1 * 1/2018 Thomas ..... A47C 27/083
10,327,564 B1 * 6/2019 Schulman ..... A47C 27/07
2005/0166329 A1 * 8/2005 Carlitz ..... A47C 31/123 5/721
2005/0223667 A1 * 10/2005 McCann ..... A47C 27/085 52/403.1

(Continued)

FOREIGN PATENT DOCUMENTS

CN 118844769 A * 10/2024 ..... A47C 23/00
DE 102007027029 A1 * 12/2008 ..... A47C 23/064

(Continued)

*Primary Examiner* — David E Sosnowski
(74) *Attorney, Agent, or Firm* — Blue Capital Law Firm, P.C.

(57) ABSTRACT

A mattress is disclosed. The mattress includes a support layer, a comfort layer arranged supported on the support layer and a support structure sandwiched between the support layer and the comfort layer. The support structure includes a plurality of first bars extending in a longitudinal direction and arrayed in a lateral direction and at least one second bar coupled to the plurality of first bars and supported on the plurality of first bars. The at least one second bar extends in the lateral direction and is configured to facilitate a flexing of the plurality of first bars in convex shapes when a person lies on the mattress to support a lumbar region of the person.

10 Claims, 3 Drawing Sheets

(56) References Cited

U.S. PATENT DOCUMENTS

| | | | | |
|---|---|---|---|---|
| 2009/0018857 | A1* | 1/2009 | Rawls-Meehan | A47C 7/35 705/305 |
| 2009/0089933 | A1* | 4/2009 | Letton | A47C 27/056 5/657 |
| 2010/0325809 | A1* | 12/2010 | Hsu | A47C 27/083 5/709 |
| 2012/0131752 | A1* | 5/2012 | Mason | A47C 27/148 5/655.8 |
| 2013/0081209 | A1* | 4/2013 | Young | A47C 27/063 5/739 |
| 2017/0254379 | A1* | 9/2017 | Whatcott | A47C 27/00 |
| 2017/0318981 | A1* | 11/2017 | Duwell | A47C 27/082 |
| 2018/0280216 | A1* | 10/2018 | Mascull | F16B 1/00 |
| 2018/0344046 | A1* | 12/2018 | DeFranks | A47C 21/042 |
| 2019/0174930 | A1* | 6/2019 | DeFranks | A47C 21/044 |
| 2019/0208918 | A1* | 7/2019 | DeFranks | A47C 21/044 |
| 2021/0052083 | A1* | 2/2021 | Huang | A47C 27/081 |
| 2021/0337979 | A1* | 11/2021 | Kappenman | A47C 27/144 |
| 2021/0337980 | A1* | 11/2021 | Kappenman | A47C 27/144 |
| 2022/0053946 | A1* | 2/2022 | Kappenman | A47C 27/148 |
| 2022/0192391 | A1* | 6/2022 | Kappenman | A47C 27/148 |
| 2024/0065449 | A1* | 2/2024 | Wang | A47C 27/065 |
| 2024/0260761 | A1* | 8/2024 | Carlitz | A47C 27/056 |
| 2025/0082119 | A1* | 3/2025 | Tsai | A47C 27/086 |
| 2025/0163640 | A1* | 5/2025 | Petri | D03D 11/02 |

FOREIGN PATENT DOCUMENTS

| | | | | |
|---|---|---|---|---|
| EP | 0945090 | A2 * | 9/1999 | A47C 27/20 |
| EP | 3574806 | A1 * | 12/2019 | A47C 27/062 |
| WO | WO-03063652 | A1 * | 8/2003 | A47C 23/0431 |

* cited by examiner

MATTRESS

CROSS-REFERENCE TO RELATED APPLICATIONS

This application claims priority to and the benefit of U.S. Provisional Patent Application No. 63/454,033, filed on Mar. 22, 2023, the entire disclosure of which is incorporated herein in its entirety by reference.

FIELD

The present disclosure relates, generally, to a mattress. More particularly, the present disclosure pertains to a mattress that supports a lumbar region of a person when the person lies on the mattress.

BACKGROUND

Mattresses used for sleeping have been made in more or less the same shape and are made from the same materials since many years. Mattresses typically use layers of foam having uniform thickness and include material having identical hardness and firmness throughout the entire thickness of the layers. Accordingly, the layers of foam are compressed evenly when a person is lying on the mattress. However, the layers of the mattresses do not adapt in an optimum manner to the varying anatomical forms of the persons.

SUMMARY

One aspect of this disclosure relates to a mattress. The mattress includes a support layer and a comfort layer arranged supported on the support layer, a support structure sandwiched between the support layer and the comfort layer. The support structure includes a plurality of first bars extending in a longitudinal direction and arrayed in a lateral direction, at least one second bar coupled to the plurality of first bars and supported on the plurality of first bars. The at least one second bar extends in the lateral direction and is configured to facilitate a flexing of the plurality of first bars in convex shapes when a person lies on the mattress to support a lumbar region of the person.

In some additional, alternative, or selectively cumulative embodiments, the at least one second bar is supported on middle portions of the plurality of the first bars, the middle portions are arranged to flex upwardly relative to ends of the plurality of first bars to support the lumbar region of the person.

In some additional, alternative, or selectively cumulative embodiments, the plurality of first bars is arranged such that first longitudinal ends of the plurality of first bars are adapted to be arranged underneath a shoulder region of the person when the person lies on the mattress, and second longitudinal ends of the plurality of first bars are adapted to be arranged underneath a hip region of the person.

In some additional, alternative, or selectively cumulative embodiments, the support structure further includes a cover to enclose the plurality of first bars and the plurality of second bars.

In some additional, alternative, or selectively cumulative embodiments, the cover includes a plurality of first sleeves configured to receive and enclose the plurality of first bars.

In some additional, alternative, or selectively cumulative embodiments, the cover includes at least one second sleeve extending substantially perpendicular to the plurality of first sleeves and configured to receive and enclose the one or more of the second bars.

In some additional, alternative, or selectively cumulative embodiments, the at least one second sleeve includes a plurality of second sleeves arrayed in the longitudinal direction and adapted to removably receive the at least one second bar.

In some additional, alternative, or selectively cumulative embodiments, one or more of plurality of first bars includes two carbon fiber strips laminated together.

In some additional, alternative, or selectively cumulative embodiments, a cross-sectional area of one or more of the plurality of first bars varies from a central/middle portion of the first bars towards ends of the first bar.

DETAILED DESCRIPTION

Figure 1:
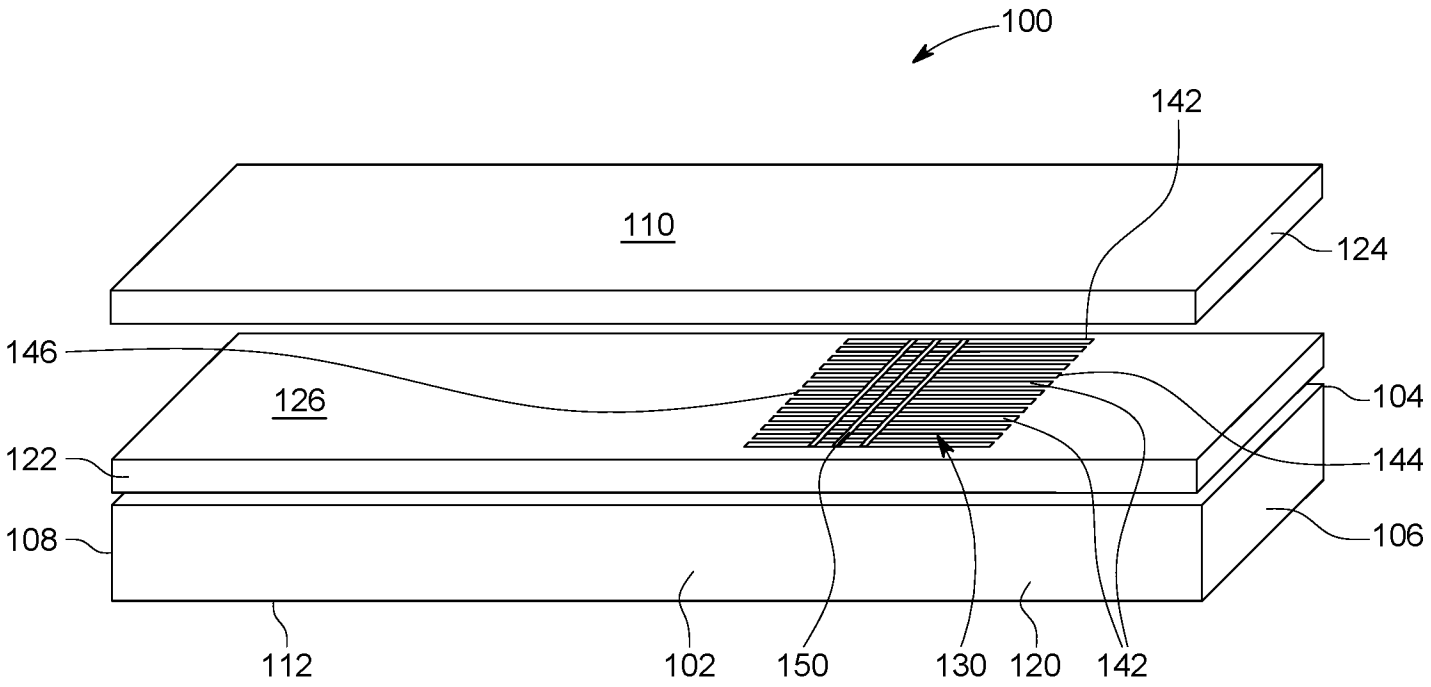
FIG. 1 illustrates an exploded view of a mattress having a support structure, in accordance with an embodiment of the disclosure.

Exemplary embodiments are described below with reference to the accompanying drawings. Unless otherwise expressly stated in the drawings, the sizes, positions, etc., of components, features, elements, etc., as well as any distances therebetween, are not necessarily to scale, and may be disproportionate and/or exaggerated for clarity.

The terminology used herein is for the purpose of describing example embodiments only and is not intended to be limiting. As used herein, the singular forms "a," "an" and "the" are intended to include the plural forms as well, unless the context clearly indicates otherwise. It should be recognized that the terms "comprise," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise specified, a range of values, when recited, includes both the upper and lower limits of the range, as well as any sub-ranges therebetween. Unless indicated otherwise, terms such as "first," "second," etc., are only used to distinguish one element from another. For example, one element could be termed a "first element" and similarly, another element could be termed a "second element," or vice versa. The section headings used herein are for organizational purposes only and are not to be construed as limiting the subject matter described.

Unless indicated otherwise, the terms "about," "thereabout," "substantially," etc., mean that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art.

Spatially relative terms, such as "right," left," "below," "beneath," "lower," "above," and "upper," and the like, may be used herein for ease of description to describe one element's or feature's relationship to another element or feature, as illustrated in the drawings. It should be recognized that the spatially relative terms are intended to encompass different orientations in addition to the orientation depicted in the figures. For example, if an object in the figures is turned over, elements described as "below" or "beneath" other elements or features would then be oriented "above" the other elements or features. Thus, the term "below" can, for example, encompass both an orientation of above and below. An object may be otherwise oriented (e.g., rotated 90 degrees or at other orientations) and the spatially relative descriptors used herein may be interpreted accordingly.

Unless clearly indicated otherwise, all connections and all operative connections may be direct or indirect. Similarly, unless clearly indicated otherwise, all connections and all operative connections may be rigid or non-rigid.

Like numbers refer to like elements throughout. Thus, the same or similar numbers may be described with reference to other drawings even if they are neither mentioned nor described in the corresponding drawing. Also, even elements that are not denoted by reference numbers may be described with reference to other drawings.

Many different forms and embodiments are possible without deviating from the spirit and teachings of this disclosure and so this disclosure should not be construed as limited to the example embodiments set forth herein. Rather, these example embodiments are provided so that this disclosure will be thorough and complete, and will convey the scope of the disclosure to those skilled in the art.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments.

Reference will now be made in detail to specific embodiments or features, examples of which are illustrated in the accompanying drawings. Generally, corresponding reference numbers will be used throughout the drawings to refer to the same or corresponding parts. Also, wherever possible, the same reference numbers will be used throughout the drawings to refer to the same or the like parts.

Figure 2:
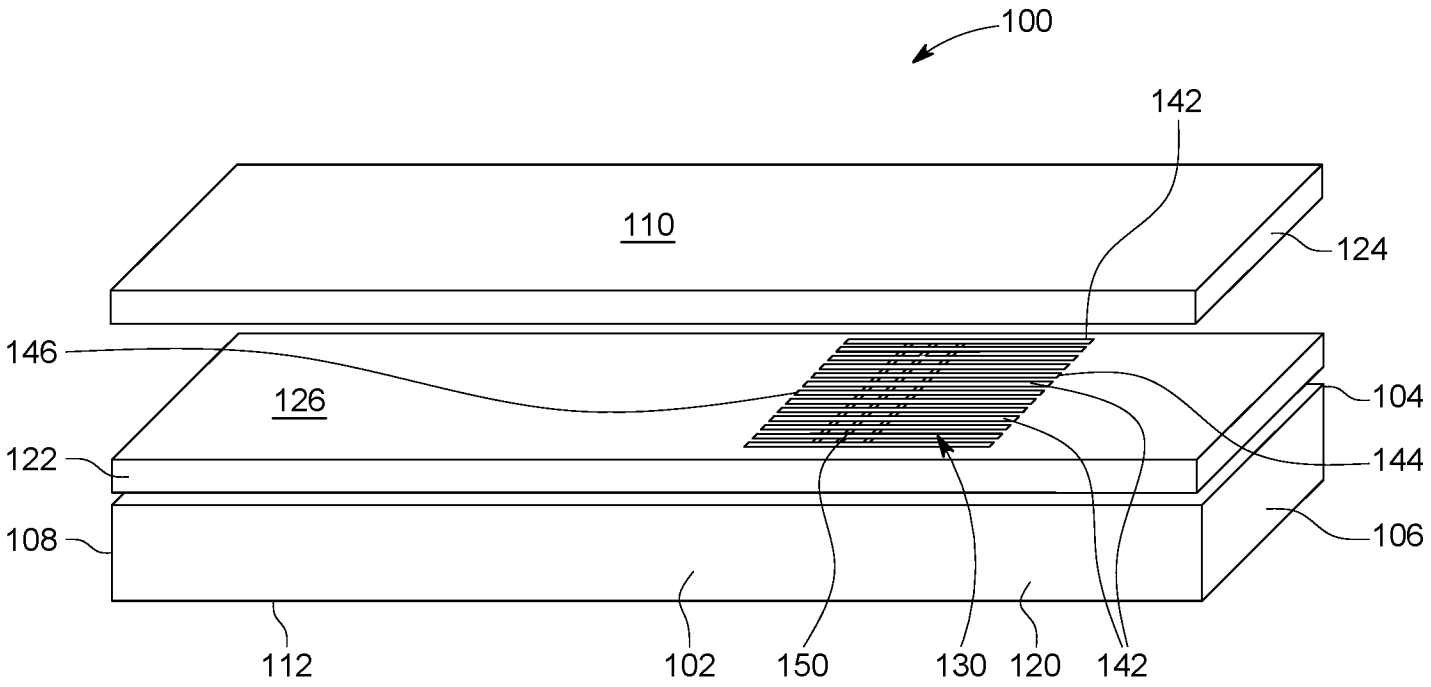
FIG. 2 illustrates an exploded view of a mattress having the support structure, in in accordance with an embodiment of the disclosure.

Referring to FIGS. 1 and 2, a mattress 100 is shown according to example embodiments of the disclosure. The mattress 100 may be a rectangular mattress having a pair of longitudinal sides 102, 104 and a pair of lateral sides 106, 108 extending between the pair of longitudinal sides 102, 104. The mattress 100 also includes a first surface 110 on which a person lies and a second surface 112 adapted to contact a surface, for example, a bed or a ground. As shown, the mattress 100 includes a first layer 120 (i.e., a base layer 120) defining a bottom portion of the mattress 100, a second layer 122 (i.e., a support layer 122) arranged contacting the base layer 120 and supported on the base layer 120, and a third layer 124 (i.e., a top layer 124) arranged contacting the second layer 122 and supported on the second layer 122 defining a comfort layer of the mattress 100. As shown, each of the layers 120, 122, 124 extends from a first longitudinal side 102 to a second longitudinal side 104 of the mattress 100 and extends from a first lateral side 106 to a second lateral side 108 of the mattress 100. The first layer and the second layer together constitute a base structure of the mattress, while the comfort layer defines a top structure of the mattress.

As shown, the support layer 122 is arranged/sandwiched between the base layer 120 and the top layer 124. In some embodiments, an upper surface 126 of the support layer 122 is adhesively attached to a bottom surface of the top layer 124, and a lower surface of the support layer 122 is attached to a top surface of the base layer 120. In some embodiments, the top layer 124 is softer relative to the support layer 122 and the base layer 120 is harder relative to the support layer 122. In some embodiments, one or more of the layers 122, 124 may be made of a soft foam material, for example, memory foam, latex foam, and polyurethane form. In some embodiments, the base layer 120 may be made of a foam material, for example, polyurethane form or coconut coir. In an embodiment, the base layer 120 may include a plurality of springs or coils embedded inside the layer. Although, three layers 120, 122, 124 are shown, it may be appreciated that the base layer 120 may be omitted.

The mattress 100 further includes a support structure 130 coupled to the support layer 122 and arranged proximate to the upper surface 126 of the support layer 122. In an embodiment, the support structure 130 is arranged contacting the upper surface 126 and is stitched or adhesively coupled to the upper surface 126 of the support layer 122. Alternatively, the support structure 130 may be embedded inside the foam of the support layer 122. For so doing, the support layer 122 may include suitable cut-outs or slots extending downwardly from the upper surface 126 of the support layer 122. It may be appreciated that the dimensions of the slots/cut-outs correspond to the dimensions of various elements of features of the support structure 130. The support structure 130 is configured to flex in an arch shape, for example, a convex shape, to support a lumbar portion of the person when the person lies on the mattress 100.

As shown, the support structure 130 includes a plurality of bars having a plurality of first bars 142 extending in a longitudinal direction (i.e., substantially parallel to longitudinal sides 102, 104 of the mattress 100) and arrayed in a lateral direction between the first longitudinal side 102 and the second longitudinal side 104. As shown, the first bars 142 are arranged spaced apart from each other and are disposed substantially parallel to each other. Moreover, a first longitudinal end 144 of each of the first bar 142 is arranged proximate to the first lateral side 106 such that the first longitudinal ends 144 of the first bars 142 are disposed underneath or directly below a shoulder region of the person when the person lies on the mattress 100, while a second longitudinal end 146 of each first bar 142 is arranged distally from the first lateral side 106 such that the second longitudinal ends 146 of the first bars 142 are arranged underneath or directly below a hip region of the person when the person lies on the mattress 100.

Moreover, the plurality of bars includes at least one second bar 150 disposed/arranged/extending substantially parallel to the lateral sides 106, 108 of the mattress 100 and coupled to the first bars 142. The at least one second bar 150 is located between the first longitudinal ends 144 and the second longitudinal ends 146 of the first bars 142 such that the at least one second bar 150 is arranged at a desired location underneath a lumbar region of the person when the person lies on the mattress 100. As shown in FIG. 1, the at least one second bar 150 is arranged above the plurality of the first bars 142, while the at least one second bar 150, as shown in FIG. 2, is arranged underneath the plurality of first bars 142. Moreover, the at least one second bar 150 may be arranged so as to facilitate a flexing of the first bars 142 in convex shapes such that apexes of the convex shapes are arranged proximate to the at least one second bar 150 to support the lumbar region of the person when the person lies on the mattress 100. In fact, the connections of the at least one second bar 150 with the plurality of first bars 142 acts as fulcrums for the plurality of first bars 150, and the ends 144, 146 of the first bars 150 move/flex downwardly relative to the fulcrums to enable the bending of the first bars 150 in the convex shapes, and accordingly, middle portions of the first bars 142 supports the lumbar region of the user when the user lies on the mattress 100.

In an embodiment, the plurality of bars 142, 150 may be carbon fiber flat bars. In some embodiments, the at least one second bar 150 is a carbon fiber bar, while the plurality of first bars 142 includes spring steel bars. Alternatively, the plurality of bars 142, 150 may be made from other suitable rigid material, such as wood, metal, alloys etc. using any other suitable manufacturing technique, such as, extrusion and casting. In an embodiment, the plurality of first bars 142 may be between 50 centimeters (cm) to 75 centimeters long and has a cross-sectional dimension of 1 cm×2 mm and the at least one second bar 150 may be 60 cm long and has a cross-sectional dimension of 2-3 millimeters (mm)×10-30 mm, preferably of 1.5 mm×15 mm. However, the length and the cross-sectional dimensions of the bars 142,150 may vary based upon the support required to the person.

Figure 3:
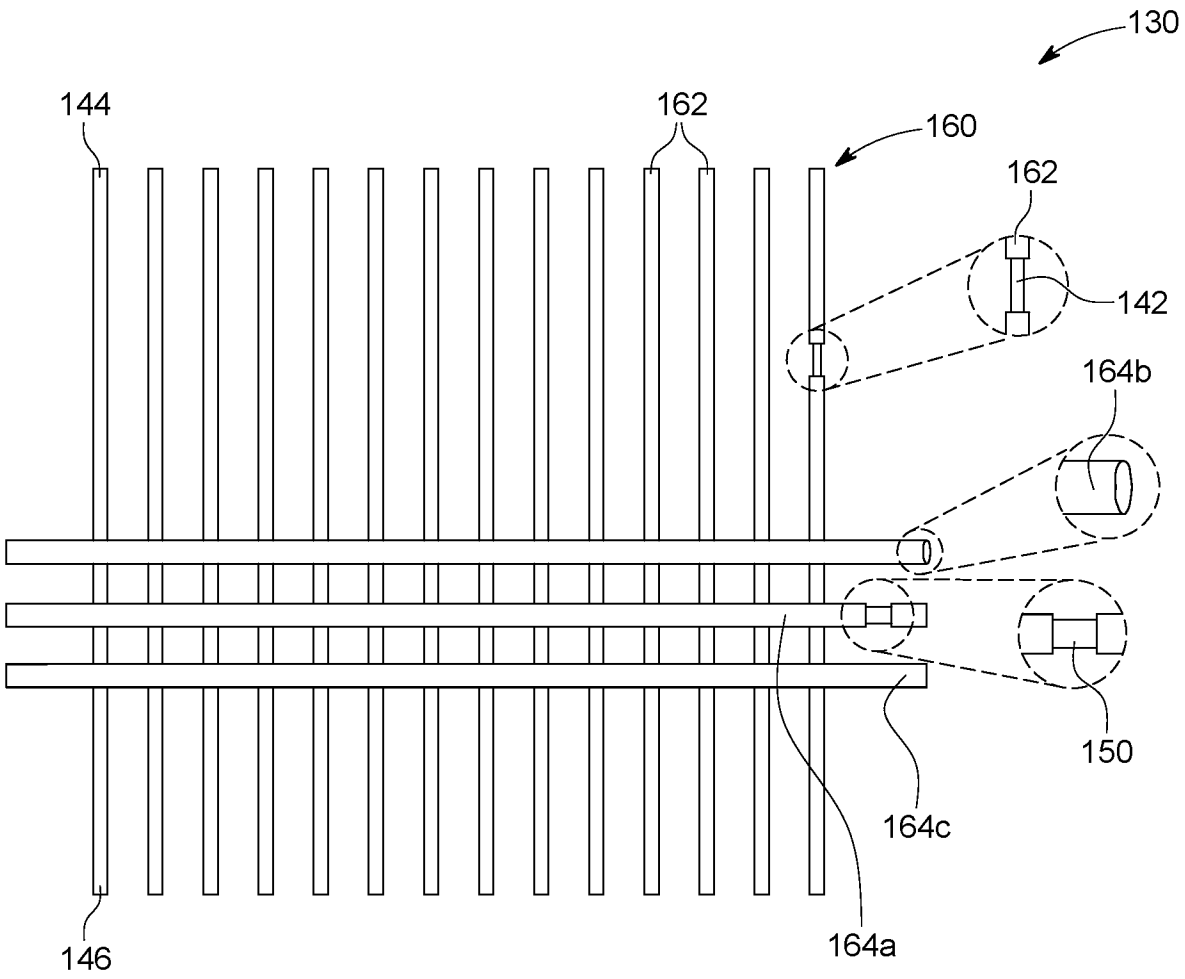
FIG. 3 illustrates the support structure of the mattress, in accordance with an embodiment of the disclosure.

Referring to FIG. 3, the support structure 130 further includes a cover 160 to enclose or cover the plurality of bars 142, 150. As shown, the cover 160 includes a plurality of first sleeves 162 configured to receive and enclose the plurality of first bars 142 and at least one second sleeve 164, for example three second sleeves 164*a*, 164*b*, 164*c*, extending substantially perpendicular to the plurality of first sleeves 162. Each of the second sleeves is configured to receive and enclose one second bar 150. As shown, the second sleeves 164 are arranged spaced apart and substantially parallel to each other and are coupled to the plurality of first sleeves 162. In an embodiment, the second sleeves 164 are stitched or adhesively attached to the first sleeves 162. In an embodiment, the first sleeves 162 and the second sleeves 164 may be a tubular knit nylon strap. In some embodiments, the sleeves 164*b*, 164*c* may be omitted.

As illustrated, the support structure 130 may include a single second bar 150 and in such a case the second bar 150 is arranged inside one of the second sleeves 164, for example, the second sleeve 164*a* and other second sleeves 164*b*, 164*c* are empty. This facilitates removal of the second bar 150 from the second sleeve 164*a* and insertion of the second bar 150 in any of the other second sleeves 164*b*, 164*c* to configure/provide the lumbar support at a desired location depending upon the person preference and physiology of the person. The cover 160 enables easy coupling/attachment of the bars 142, 150 with each other and with the support layer 122. Also, as the sleeves 162, 164 are made of fabric and relatively soft material, the sleeves 162, 164 prevent abrasion and the damage to the support layer 122 due to repeated flexing and unflexing of the bars 142, 150.

In use, when the person lies on the mattress 100 ends 144, 146 of the plurality of first bars 142 extends downwards due to the compression of the mattress 100 caused by the shoulder region and the hip region of the person and the fulcrums provided by the connections of the at least one second bar 150 with the plurality of first bars 142. This additional compression of the ends 144, 146 of the first bars 142 results into an upward deflection of the middle portions of the first bars 142 and movement the at least one second bar 150 upwardly. It may be appreciated as the second bar 150 is coupled to each of the first bars 142, the first bars 142 moves in an arch shape, resulting the support structure 130 to flex in an arch shape inside similar to a natural shape of the back of the person, providing additional support to the lumbar region of the person. Additionally, due to selective insertion of the second bar 150 in the plurality of the second sleeves 134 a variation in the arch shape of the support structure 130 is achieved to facilitate a desired support to the lumbar area of the person.

In an alternative embodiment, the plurality of first bars 142 may include two strips of material, for example, two carbon fiber strips laminated together to increase the flexibility of the first bars 142 to facilitate improved deflection of the at least one second bar 150. In some embodiments, the first bars 142 may include varying cross sections (either width and/or thickness) to achieve improved flexibility. In some embodiments, the cross-sectional area (i.e., width and/or thickness) may decrease from the central/middle portion of the first bars 142 towards the ends 144, 146.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

Various aspects of the disclosure have been described above. It should be apparent that the teachings herein may be embodied in a wide variety of forms and that any specific structure, function, or both being disclosed herein is merely representative. Based on the teachings herein one skilled in the art should appreciate that an aspect disclosed herein may be implemented independently of any other aspects and that two or more of these aspects may be combined in various ways. For example, an apparatus may be implemented or a method may be practiced using any number of the aspects set forth herein. In addition, such an apparatus may be implemented or such a method may be practiced using other structure, functionality, or structure and functionality in addition to or other than one or more of the aspects set forth herein.

The invention claimed is:

1. A mattress, comprising:

a support layer;

a comfort layer arranged supported on the support layer; and a support structure sandwiched between the support layer and the comfort layer, the support structure being configured to support a lumbar region of a person when the person lies on the mattress, the support structure including:

a plurality of first bars extending in a longitudinal direction and arrayed in a lateral direction; and at least one second bar extending in the lateral direction, the at least one second bar coupled to and supported on middle portions of the plurality of first bars and absent from oppositely defined ends of the plurality of first bars such that connections of the at least one second bar with the plurality of first bars act as fulcrums for the plurality of first bars causing said ends of the plurality of first bars to flex or bend relative to the fulcrums to facilitate a flexing of the plurality of first bars in convex shapes.

2. The mattress of claim 1, wherein the middle portions are arranged to flex upwardly relative to ends of the plurality of first bars to support the lumbar region of the person.

3. The mattress of claim 1, wherein the plurality of first bars is arranged such that first longitudinal ends of the plurality of first bars are adapted to be arranged underneath a shoulder region of the person when the person lies on the mattress, and second longitudinal ends of the plurality of first bars are adapted to be arranged underneath a hip region of the person.

4. The mattress of claim 1, wherein the support structure further includes a cover to enclose the plurality of first bars and the plurality of second bars.

5. The mattress of claim 4, wherein the cover includes a plurality of first sleeves configured to receive and enclose the plurality of first bars.

6. The mattress of claim 4, wherein the cover includes at least one second sleeve extending substantially perpendicular to the plurality of first sleeves and configured to receive and enclose the one or more of the second bars.

7. The mattress of claim 6, wherein the at least one second sleeve includes a plurality of second sleeves arrayed in the longitudinal direction and adapted to removably receive the at least one second bar.

8. The mattress of claim 1, wherein one or more of plurality of first bars includes two carbon fiber strips laminated together.

9. The mattress of claim 1, wherein a cross-sectional area of one or more of the plurality of first bars varies from a central/middle portion of the first bars towards ends of the first bar.

10. The mattress of claim 1 further including:

a plurality of first sleeves configured to correspondingly receive and enclose the plurality of first bars; and a plurality of second sleeves coupled to the plurality of first sleeves, the plurality of second sleeves configured to selectively receive and enclose the at least one second bar such that the at least one second bar is positionable at a desired location with respect to the plurality of first bars to achieve variation in a shape of the support structure, facilitating desired support to the lumbar region of the person when the person lies on the mattress.

* * * * *